US008849640B2

(12) United States Patent
Holl et al.

(10) Patent No.: US 8,849,640 B2
(45) Date of Patent: Sep. 30, 2014

(54) SYSTEM AND METHOD FOR PLANNING A DRILLING OPERATION

(75) Inventors: James E. Holl, Houston, TX (US); Yao-Chou Cheng, Houston, TX (US); Marek Czernuszenko, Sugar Land, TX (US); Rune Musum, Stavanger (NO); Jose Sequeira, The Woodlands, TX (US); Hendrik Braaksma, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 311 days.

(21) Appl. No.: 13/058,312

(22) PCT Filed: Aug. 31, 2009

(86) PCT No.: PCT/US2009/055523
§ 371 (c)(1),
(2), (4) Date: Feb. 9, 2011

(87) PCT Pub. No.: WO2010/053618
PCT Pub. Date: May 14, 2010

(65) Prior Publication Data

US 2011/0153300 A1 Jun. 23, 2011

Related U.S. Application Data

(60) Provisional application No. 61/111,981, filed on Nov. 6, 2008.

(51) Int. Cl.

| | |
|---|---|
| ***G06G 7/48*** | (2006.01) |
| ***E21B 47/022*** | (2012.01) |
| *E21B 41/00* | (2006.01) |
| *E21B 49/00* | (2006.01) |

(52) U.S. Cl.
CPC ..... *E21B 47/022* (2013.01); *E21B 41/0092* (2013.01); *E21B 49/00* (2013.01)
USPC ..... 703/10

(58) Field of Classification Search
CPC ..... E21B 49/00; E21B 7/24; G05B 19/41885; G06Q 10/06312
USPC ..... 703/10
See application file for complete search history.

(56) References Cited

U.S. PATENT DOCUMENTS 5,671,136 A 9/1997 Willhoit
5,992,519 A 11/1999 Ramakrishnan et al.

(Continued)

FOREIGN PATENT DOCUMENTS

CA 2312381 6/1999
EP 1230566 11/2000

(Continued)

OTHER PUBLICATIONS

Cayeux, E., Crepin, S., Genevois, J.M., Thibeau, S., Well Planning Quality Improved Using Cooperation Between Drilling and Geosciences, 2001 Annu, SPE Tech Conf. (New Orleans, LA Sep. 30, 2001-Oct. 3, 2001) SPE 71331.

(Continued)

*Primary Examiner* — Aniss Chad
(74) *Attorney, Agent, or Firm* — ExxonMobil Upstream Research Company Law Dept.

(57) ABSTRACT

A method of planning a drilling operation IS provided that comprises selecting a set of targeted regions based on data from a three-dimensional shared earth model and generating at least one targeted segment within each one of the set of targeted regions The method further comprises defining at least one application agent for the purpose of evaluating the at least one targeted segment within each one of the set of targeted regions based on a potential payout in terms of production of hydrocarbons The exemplary method additionally comprises identifying at least one well trajectory through the at least one targeted segment within each one of the set of targeted regions And the method comprises employing the at least one application agent to evaluate well trajectories based on the potential payout in terms of at least one of production of hydrocarbons, drilling complexity, cost or stability of well planning.

18 Claims, 8 Drawing Sheets

(56) References Cited

U.S. PATENT DOCUMENTS

| | | | | |
|---|---|---|---|---|
| 6,035,255 | A | 3/2000 | Murphy et al. | |
| 6,044,328 | A | 3/2000 | Murphy et al. | |
| 6,070,125 | A | 5/2000 | Murphy et al. | |
| 6,191,787 | B1 | 2/2001 | Lu et al. | |
| 6,236,994 | B1 | 5/2001 | Swartz et al. | |
| 6,373,489 | B1 | 4/2002 | Lu et al. | |
| 6,388,947 | B1 | 5/2002 | Washbourne et al. | |
| 6,519,568 | B1 | 2/2003 | Harvey et al. | |
| 6,549,854 | B1 | 4/2003 | Malinverno et al. | |
| 6,549,879 | B1 | 4/2003 | Cullick et al. | |
| 6,757,613 | B2 | 6/2004 | Chapman et al. | |
| 6,765,570 | B1 | 7/2004 | Cheung et al. | |
| 6,772,066 | B2 | 8/2004 | Cook | |
| 6,823,266 | B2 | 11/2004 | Czernuszenko et al. | |
| 6,826,483 | B1 | 11/2004 | Anderson et al. | |
| 6,829,570 | B1 | 12/2004 | Thambynayagam et al. | |
| 6,912,467 | B2 | 6/2005 | Schuette | |
| 6,968,909 | B2 | 11/2005 | Aldred et al. | |
| 6,980,940 | B1 | 12/2005 | Gurpinar et al. | |
| 6,993,434 | B2 | 1/2006 | Cheng et al. | |
| 7,003,439 | B2 | 2/2006 | Aldred et al. | |
| 7,027,925 | B2 | 4/2006 | Terentyev et al. | |
| 7,031,842 | B1 | 4/2006 | Musat et al. | |
| 7,079,953 | B2 | 7/2006 | Thorne et al. | |
| 7,096,172 | B2 | 8/2006 | Colvin et al. | |
| 7,098,908 | B2 | 8/2006 | Acosta et al. | |
| 7,181,380 | B2 | 2/2007 | Dusterhoft et al. | |
| 7,281,213 | B2 | 10/2007 | Callegari | |
| 7,283,941 | B2 | 10/2007 | Horowitz et al. | |
| 7,337,067 | B2 | 2/2008 | Sanstrom | |
| 7,437,358 | B2 | 10/2008 | Arrouye et al. | |
| 7,460,957 | B2 | 12/2008 | Prange et al. | |
| 7,478,024 | B2 | 1/2009 | Gurpinar et al. | |
| 7,546,884 | B2 * | 6/2009 | Veeningen et al. | 175/40 |
| 7,596,481 | B2 | 9/2009 | Zamora et al. | |
| 7,603,264 | B2 | 10/2009 | Zamora et al. | |
| 7,606,666 | B2 | 10/2009 | Repin et al. | |
| 7,616,213 | B2 | 11/2009 | Chuter | |
| 7,627,430 | B2 | 12/2009 | Hawtin | |
| 7,630,914 | B2 | 12/2009 | Veeningen et al. | |
| 7,657,414 | B2 | 2/2010 | Zamora et al. | |
| 7,684,929 | B2 | 3/2010 | Prange et al. | |
| 7,725,302 | B2 | 5/2010 | Ayan et al. | |
| 7,796,468 | B2 | 9/2010 | Kellogg | |
| 7,876,705 | B2 | 1/2011 | Gurpinar et al. | |
| 7,913,190 | B2 | 3/2011 | Grimaud et al. | |
| 7,925,483 | B2 | 4/2011 | Xia et al. | |
| 7,991,600 | B2 | 8/2011 | Callegari | |
| 7,995,057 | B2 | 8/2011 | Chuter | |
| 8,094,515 | B2 | 1/2012 | Miller et al. | |
| 8,103,493 | B2 | 1/2012 | Sagert et al. | |
| 8,199,166 | B2 | 6/2012 | Repin et al. | |
| 8,325,179 | B2 | 12/2012 | Murray et al. | |
| 8,346,695 | B2 | 1/2013 | Pepper et al. | |
| 8,364,404 | B2 | 1/2013 | Legendre et al. | |
| 2002/0013687 | A1 | 1/2002 | Ortoleva | |
| 2005/0015231 | A1 | 1/2005 | Edwards et al. | |
| 2005/0209836 | A1 | 9/2005 | Klumpen et al. | |
| 2005/0209912 | A1 | 9/2005 | Veeningen et al. | |
| 2005/0211468 | A1 | 9/2005 | Veeningen et al. | |
| 2005/0234690 | A1 | 10/2005 | Mainguy et al. | |
| 2006/0074561 | A1 | 4/2006 | Xia et al. | |
| 2006/0136162 | A1 | 6/2006 | Hamman et al. | |
| 2006/0161406 | A1 | 7/2006 | Kelfoun | |
| 2007/0027666 | A1 | 2/2007 | Frankel | |
| 2007/0076044 | A1 | 4/2007 | Corley, Jr. et al. | |
| 2007/0079652 | A1 | 4/2007 | Craig | |
| 2007/0156377 | A1 | 7/2007 | Gurpinar et al. | |
| 2007/0199721 | A1 | 8/2007 | Givens et al. | |
| 2007/0266082 | A1 | 11/2007 | McConnell et al. | |
| 2008/0088621 | A1 | 4/2008 | Grimaud et al. | |
| 2008/0091355 | A1 | 4/2008 | Sanstrom | |
| 2008/0109490 | A1 | 5/2008 | Arnegaard et al. | |
| 2008/0165185 | A1 | 7/2008 | Smith et al. | |
| 2008/0165186 | A1 | 7/2008 | Lin | |
| 2008/0289877 | A1 | 11/2008 | Nikolakis-Mouchas et al. | |
| 2008/0306803 | A1 | 12/2008 | Vaal et al. | |
| 2009/0027380 | A1 | 1/2009 | Rajan et al. | |
| 2009/0027385 | A1 | 1/2009 | Smith | |
| 2009/0037114 | A1 | 2/2009 | Peng et al. | |
| 2009/0043507 | A1 | 2/2009 | Dommisse et al. | |
| 2009/0125362 | A1 | 5/2009 | Reid et al. | |
| 2009/0200014 | A1 | 8/2009 | Schottle et al. | |
| 2009/0222742 | A1 | 9/2009 | Pelton et al. | |
| 2010/0191516 | A1 | 7/2010 | Benish et al. | |
| 2010/0206559 | A1 | 8/2010 | Sequeira, Jr. et al. | |
| 2011/0044532 | A1 | 2/2011 | Holl et al. | |
| 2011/0153300 | A1 | 6/2011 | Holl et al. | |
| 2012/0150449 | A1 | 6/2012 | Dobin | |
| 2012/0166166 | A1 | 6/2012 | Czernuszenko | |

FOREIGN PATENT DOCUMENTS

| | | |
|---|---|---|
| WO | 99/28767 | 6/1999 |
| WO | 00/14574 | 3/2000 |
| WO | WO03/072907 | 9/2003 |
| WO | WO03/078794 | 9/2003 |
| WO | WO2006/065915 | 6/2006 |
| WO | WO2007/076044 | 7/2007 |
| WO | WO2007/100703 | 9/2007 |
| WO | 2008/121950 | 10/2008 |
| WO | 2009/039422 | 3/2009 |
| WO | 2009/148681 | 12/2009 |
| WO | 2011/038221 | 3/2011 |

OTHER PUBLICATIONS

Cox, H., Gras, R., and Sagert, R., 3-D Visualization, Automation Speed Interpretation Workflow, Sep. 1998, World Oil vol. 219, No. 9, pp. 45-46, 48, 50.

Gawith, D.E., Gutteridge, P.A., Seismic Validation of Reservoir Simulation Using a Shared Earth Model, May 1996, Petroleum Geoscience, vol. 2, pp. 97-103.

Gutteridge, P.A., and Gawith, D.E., Bringing Sedimentology Into Shared Earth Models to Improve Reservoir Simulation, Jun. 3-7, 1996, 58th Eage Conf. (Amsterdam, Neth, Jun. 3-7, 1996) Extended Abstr. vol. 2, pap. No. L026.

Sacrey, D.K., Visualization Enhances Interpretation, Jul. 2000, Amer. Oil Gas Reporter , vol. 43, No. 7; pp. 129, 131-133.

Smith, Reid G., and Maitland, Geoffrey C., The Road Ahead to Real-Time Oil & Gas Reservoir Management, Dec. 1998, pp. 1-32. In UK Transactions of the Institution of Chemical Engineers: Chemical Engineering Research and Design, vol. 76A, pp. 539-552; http://www.rgsmithassociates.com/Road_Ahead_to_Real-Time_Reservoir_Management_1998.pdf.

* cited by examiner

SYSTEM AND METHOD FOR PLANNING A DRILLING OPERATION

CROSS-REFERENCE TO RELATED APPLICATION

This application is the National Stage of International Application No. PCT/US2009/055523, that published as WO2010/053618, filed 14 May 2010 which claims the benefit of U.S. Provisional Application No. 61/111,981, filed 6 Nov. 2008. The entirety of each of these applications is incorporated herein by reference for all purposes.

FIELD OF THE INVENTION

Exemplary embodiments of the present invention relate to a system and method for planning a drilling operation. In particular, an exemplary embodiment of the present invention is associated with defining optimal target locations and well trajectory plans within a three dimensional shared earth model.

BACKGROUND OF THE INVENTION

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

While the task of well path planning is primarily an engineering function, a high-degree of geosciences, engineering integration and collaboration is involved during the planning process to achieve optimal results. In general, existing work processes and software tools lack the dynamic data integration capabilities required for interactive, cross-functional analysis and field development and management decisions.

Planning oil and gas wells involves designing well trajectories to optimally penetrate reservoir intervals while avoiding possible drilling hazards (e.g. shallow gas-bearing sands), and maximizing borehole stability and cost-effectiveness given the properties (e.g. temperature, stress, fluid pressure) of the stratigraphic column between the surface location and drilling targets. Current well design practices are often sequential, inefficient, and lack the tools and interactivity to adequately optimize a well design given a complex and uncertain three-dimensional distribution of possible reservoir intervals and drilling obstacles (hazards).

For example, a typical well planning workflow employing known technology may select potential subsurface targets. Potential targets are selected by a geoscientist based on a geologic interpretation and understanding of reservoir properties. Historically, this target selection step has been done using two-dimensional maps of reservoir horizons (e.g. base or top reservoir). More recently, to facilitate collaborative work practices and the visualization and evaluation of complex well designs, target selection may be done within a three-dimensional visualization environment. A drawback of existing three-dimensional visualization techniques is that they generally lack sufficient data to provide satisfactory results. For the purposes of well trajectory creation, target locations selected during this step are represented by points in three-dimensional space, each single point defined using an (X, Y, Z) coordinate to represent a target location. To assess the feasibility of the proposed targets, a three-dimensional visualization environment such as (for example, Gocad by T-Surf, Petrel by Schlumberger, or the like) may be used by a geoscientist and/or a drilling engineer to create a preliminary well trajectory based on the selected target points and user-defined screening-level constraints on the geometry of the well trajectory (e.g. dog-leg severity, also referred to as DLS). In cases where the initial target points are determined to be unacceptable, target locations can be removed or modified until an acceptable first-pass well trajectory has been generated. While the use of three-dimensional visualization tools to screen target locations is not uncommon, in many cases this step is bypassed because of the insufficiency of the data.

The selected target points and in some cases a screening-level well trajectory are given to the drilling engineer for more detailed well design and analysis. Analyses include well bore stability, torque, drag and the like. Moreover, these analyses may involve an understanding of the rock and fluid properties along the trajectory. The rock and fluid property information can come from a wide variety of sources including nearby well bores and predictive models, but it is typically difficult for drilling engineers to obtain and input into their analysis software. In addition, the rock and fluid information is often stored in drilling engineering software in a way that makes it well trajectory specific. In such a case the engineer can only reuse the information to a very limited extent when evaluating a new well design. Also, if new rock and fluid data becomes available during the time between the well planning stage and actual drilling, the engineer may have to, on a well-by-well basis, update this information for each of the existing planned wells.

In addition to the selection of targets by the geoscientist and well design analysis performed by the engineers, shallow hazard specialists perform additional, often independent, evaluation of the proposed path. This analysis can result in the identification of issues that may also necessitate additional changes to the target location(s), number of targets, or basic trajectory parameters, thereby adding additional iterations and time to design the final well path.

The results of the well design and analysis typically indicate potential issues with the well as originally conceived and may necessitate changes to the target location(s), number of targets, or basic trajectory parameters. Changes may be made by the geologist and the targets/trajectory may again be sent to the drilling engineer for analysis; depending on the complexity of the well path and geology, a final trajectory may take multiple iterations and several weeks/months of calendar time. The length of time taken to iterate between target selection and detailed well design can limit the number of scenarios examined and lead to sub-optimal results.

While recent integration of three-dimensional planning methods have improved the efficiency of the target selection and well path planning work processes, significant inefficiencies and challenges remain. The variability of individual reservoir intervals and the complex arrangement of multiple reservoirs within a three-dimensional volume of the earth create an inherent complexity difficult to manage using existing tools. Defining the penetration point(s) or segment(s) for individual wells or groups of wells using a process of iteratively selecting and screening individual target points is inefficient, time consuming and leads to sub-optimal reservoir performance. In addition, creating a well path that maximizes the benefit (for example, the output of hydrocarbon resources, sometimes referred to herein as "payout" or "pay") by penetrating the most desirable reservoir zones while minimizing risk and cost by avoiding possible drilling hazards (e.g. shallow gas sands, faults and the like) while at the same time meeting engineering design specifications requires the integration of numerous multi-dimensional and multi-disciplinary data types.

The amount and complexity of the data to be analyzed and visualized exceeds the capacity of the user and the integration capabilities of current visualization systems. For example, available data may include numerous volumetric representations of the area including seismic data and its derivatives and reservoir or full-earth models representing rock or fluid property variations. Each of these volumes is typically of much greater lateral and vertical extent than the relatively small volume of the subsurface relevant during target selection and well trajectory evaluation. Currently, geologists and engineers may generate a number of display-types to integrate as much data into the evaluation and selection process as possible.

Even with these methods the visualization and analysis of relevant data for target selection and well path design or analysis is extremely difficult and time consuming. Because drilling target selection and the evaluation of resulting well trajectories is a highly iterative process, the use of three-dimensional subsurface volumes for the purpose of drilling target selection and well path design and evaluation has so far been relatively limited. In cases where geologists and engineers do use three-dimensional subsurface volumes for the purpose of drilling target selection and well path design, the amount of time involved in setting up the desired displays limits the number of target combinations/trajectories evaluated. As a result, a significant amount of time is spent inefficiently and the final selected targets and well trajectories may be sub-optimal. An improved system and method of planning a drilling operation is desirable.

SUMMARY OF THE INVENTION

A method of planning a drilling operation is provided. An exemplary embodiment of the method comprises selecting a set of targeted regions based on data from a three-dimensional shared earth model and generating at least one targeted segment within each one of the set of targeted regions. The exemplary method further comprises defining at least one application agent for the purpose of evaluating the at least one targeted segment within each one of the set of targeted regions based on a potential payout in terms of production of hydrocarbons. The exemplary method additionally comprises identifying at least one well trajectory through the at least one targeted segment within each one of the set of targeted regions. Finally, the exemplary method comprises employing the at least one application agent to evaluate the at least one well trajectory based on the potential payout in terms of at least one of production of hydrocarbons, drilling complexity, cost or well stability.

One exemplary embodiment of the present invention comprises employing the at least one application agent to iteratively evaluate successive well trajectories through the at least one targeted segment within each one of the set of targeted regions to determine an optimum well trajectory based on maximizing predicted payout of production of hydrocarbons. Another exemplary embodiment of the present invention comprises performing a drilling operation according to the optimum well trajectory.

One exemplary embodiment of the present invention comprises determining whether the at least one well trajectory is within a specified range with respect to at least one parameter and performing additional analysis with respect to the well trajectory if the at least one parameter is not within the specified range. Such an exemplary embodiment may additionally comprise performing no additional analysis with respect to the well trajectory if the at least one parameter is within the specified range. A data model may be refined based on the additional analysis.

In one exemplary embodiment of the present invention, the three-dimensional shared earth model comprises a geologic data set. The three-dimensional shared earth model may additionally comprise an engineering data set.

The at least one application agent may be adapted to define desired geometric constraints on the at least one well trajectory through the at least one targeted segment within each one of the set of targeted regions. The at least one application agent may also be adapted to define desired connectivity conditions with at least two of the set of targeted regions. In another exemplary embodiment of the present invention, the at least one application agent is adapted to produce a display of the at least one well trajectory.

One exemplary embodiment of the present invention comprises a system for planning a drilling operation. An exemplary system according to an embodiment of the invention comprises geologic input data, a well path generation and evaluation program and a reservoir simulation program. The exemplary system may also comprise a three-dimensional shared earth model that is adapted to be interacted upon by the geologic input data, the well path generation and evaluation program and the reservoir simulation program. The exemplary system may further comprise at least one application agent that is adapted to extract data from the three-dimensional shared earth model via at least one of the geologic input data, the well path generation and evaluation program or the reservoir simulation program, wherein the extracted data corresponds to a well trajectory through at least one targeted segment through a set of targeted regions.

In one exemplary system according to the invention, the at least one application agent is adapted to iteratively evaluate successive well trajectories through the at least one targeted segment within each one of the set of targeted regions to determine an optimum well trajectory based on maximizing predicted payout of production of hydrocarbons. The at least one application agent may be adapted to determine whether the at least one well trajectory is within a specified range with respect to at least one parameter. Nonlimiting examples of such parameters include expected gross reservoir thickness, expected net reservoir thickness, range of well inclination, expected volume of connected reservoir rock, net-to-gross thickness ratio, expected net pay, and expected $K_h$ (horizontal permeability).

In one exemplary system according to the invention, the at least one application agent is adapted to define desired geometric constraints on the at least one well trajectory through the at least one targeted segment within each one of the set of targeted regions. The at least one application agent may be adapted to define desired connectivity conditions with at least two of the set of targeted regions. The at least one application agent may be adapted to produce a display of the at least one well trajectory. Finally, the at least one application agent may be adapted to check at least one geometric constraint of the at least one targeted segment through the set of targeted regions.

One exemplary embodiment of the present invention is manifested as a tangible, machine-readable medium, such as a memory device in a computer system. An exemplary tangible, machine-readable medium comprises code adapted to represent geologic input data, code that is adapted to represent a well path generation and evaluation program and code that is adapted to represent a reservoir simulation program. The exemplary tangible, machine-readable medium may comprise code that is adapted to represent a three-dimensional shared earth model that is interacted upon by the geologic input data, the well path generation and evaluation program and the reservoir simulation program. The tangible, machine-readable medium in accordance with an exemplary embodiment of the present invention comprises code that is adapted to represent at least one application agent that extracts data from the three-dimensional shared earth model via at least one of the geologic input data, the well path generation and evaluation program or the reservoir simulation program, wherein the extracted data corresponds to a well trajectory through at least one targeted segment through a set of targeted regions.

DESCRIPTION OF THE DRAWINGS

The advantages of the present invention will be better understood by referring to the following detailed description and the attached drawings, in which.

Figure 1:
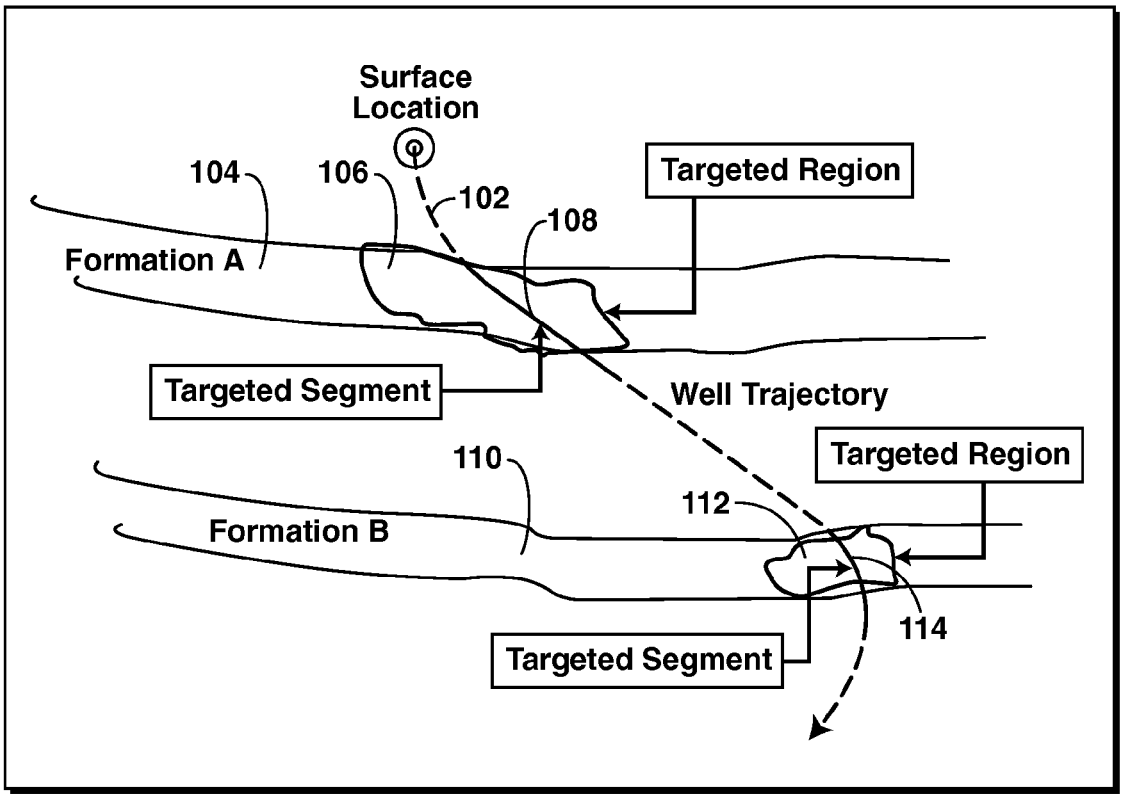
FIG. 1 is a diagram showing a well trajectory comprising targeted segments that pass through targeted regions, the well trajectory being determined in accordance with an exemplary embodiment of the present invention.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles.

DETAILED DESCRIPTION OF THE INVENTION

An exemplary embodiment of the present invention relates to providing tools and technologies to enable geoscience and engineering teams to more effectively utilize computing and networking technology to manage assets. These efforts include creating an interactive work environment within which multi-dimensional data can be displayed, explored, and analyzed to facilitate cross-functional decision making. Applications within this environment may include: remote geo-steering of wells as they are drilled; real-time update of log and well test information for rapid update of reservoir models and development drilling plans, monitoring of pressure and flow data from instrumented wells, production and work optimization and the like.

In one exemplary embodiment of the present invention, a well planning and screening process is facilitated by creating an interactive three-dimensional environment in which the user can move beyond traditional target and path definition methods (i.e., directional drilling survey calculation methods) to rapidly evaluate alternative well trajectories on the basis of user defined geometric (for example, DLS, inclination or the like), geological constraints (for example, preferred reservoir zones or potential hazards such as faults or shallow gas charged sands), and engineering constraints. The environment desirably facilitates these analyses through the use of computational planning "application agents" or "assistants". These agents or assistants may aid in the planning process by providing the capacity to embed an inherent understanding of the business or design objectives (for example, maximize pay while minimizing risk/cost) in the well path or target objects being created. This understanding may be used to provide guidance to users during interactive operations by automatically evaluating the relationship of the proposed path and/or targets to the defined constraints. User analysis and evaluation may be facilitated through a number of mechanisms including automatic creation of customized three-dimensional volumetric or other displays to highlight important relationships. Alternatively, this understanding could be used to assist in a more automated optimization process.

In one exemplary embodiment of the present invention, three-dimensional data display options may include planar or curviplanar traverses through the target or trajectory of interest displaying data extracted from a three-dimensional volume (for example, three-dimensional seismic inline/crosslines/timeslices and/or extraction of properties from the volume(s) of interest along the well path or properties displayed along well path using a log-type display or color contours. Display options may also include sub-volumes of the three-dimensional subsurface data (for example, geologic model regions showing only those geologic model cells penetrated by the resulting wellbore). Opacity may be used on these sub-volumes to restrict the data shown to only certain property ranges, thus isolating and highlighting features of interest. Another exemplary display type includes three-dimensional interactive sub-volumes representing sub-volumes of larger subsurface volumes that can be interactively moved and resized. Opacity may be used to highlight features of interest within the sub-volumes of the three-dimensional subsurface data.

Turning to the accompanying drawings, FIG. 1 is a diagram showing a well trajectory comprising targeted segments that pass through targeted regions, the well trajectory being determined in accordance with an exemplary embodiment of the present invention. The diagram is generally referred to by the reference number 100. The diagram 100 represents an exemplary subsurface region that accommodates a well trajectory 102. As used herein, the term "well trajectory" is a continuous pathway within a three-dimensional earth model that connects targeted segments and is characterized by its ability to connect the defined targeted segments while maintaining acceptable drilling complexity, cost, and stability. As will be explained in detail below, the well trajectory 102 is developed using an exemplary embodiment of the present invention to optimize return of a drilling operation in terms of cost versus benefit.

The subsurface region shown in FIG. 1 includes a first formation 104, which contains a first targeted region 106. The first targeted region 106 has been identified by interactive data such as a three-dimensional earth model as likely to contain hydrocarbons. An exemplary embodiment of the present invention identifies a first targeted segment 108 based on a likelihood that production of hydrocarbons from the first targeted region 106 may be optimized along the first targeted segment 108. As used herein, the term "targeted segment" refers to a desired path through or within a targeted region characterized by its potential to be a partial segment of a well trajectory and to recover oil and gas from the targeted region.

In the exemplary embodiment shown in FIG. 1, the well trajectory 102 passes through a second formation 110, which contains a second targeted region 112. The second targeted region 112 has been identified by interactive data. A second targeted segment 114 is identified based on a likelihood that production of hydrocarbons from the second targeted region 112 may be optimized along the second targeted segment 114. As set forth above, the interactive data used to identify the targeted regions and segments may include a three-dimensional shared earth model. The term "shared earth model" is used herein to describe a geometrical model of a portion of the earth that may also contain material properties. The model is shared in the sense that it integrates the work of several specialists involved in the model's development (non-limiting examples may include such disciplines as geologists, geophysicists, petrophysicists, well log analysts, drilling engineers and reservoir engineers) who interact with the model through one or more application programs.

In one exemplary embodiment of the present invention, a user creates a three-dimensional shared earth model including geological interpretations (e.g. horizons and faults), seismic data, geologic model, reservoir model and well data. Uncertainty associated with the data is also desirably taken into consideration. The user may also create an earth property model extending from the seafloor (or land surface) to below possible well total depth locations (sufficiently below the target reservoir interval(s) to accommodate a "rat hole", the hole of a diameter smaller than the main borehole that is drilled in the bottom of the main borehole)

Properties within the model may include, for example, pore pressure, fracture gradient, temperature, lithology (e.g., sand/shale), and stress orientation and magnitude. These properties may be calculated or derived using multiple methods, including, but not limited to predictive equations based on measured or inferred gradients, offset well information, lithology estimates and the like. Those of ordinary skill in the art will appreciate that this data may be derived from three-dimensional seismic data or other volumetric properties (for example, impedance) or interpolated from offset wells. Properties may be pre-calculated and stored in a three-dimensional volume and/or in some cases calculated when needed. Computational tools that may be useful in processing data associated with the three-dimensional shared earth model include, but are not limited to, engineering application programs such as well path generation and evaluation programs, well performance analysis tools, reservoir simulation programs, three-dimensional visualization tools and optimization packages.

Based on the three-dimensional shared earth model, a user may identify targeted regions such as the first targeted region 106 and the second targeted region 112. Targeted regions are selected within the shared earth model based on geoscience and/or reservoir engineering criteria (e.g. reservoir sweet spots, well locations optimized through reservoir simulation or the like). Moreover, the user may define constraints that a region has to meet to be identified as a targeted region. Unlike existing workflows, the targets may generally be specified as three dimensional regions within the reservoir interval(s) of interest rather than specific X, Y, Z locations. According to an exemplary embodiment of the present invention, targeted regions may be defined using a variety of approaches. For example, targeted regions could be defined using an interpreted surface or surfaces and polygons representing the region of those surfaces defined to be the most desirable target area (e.g. containing the best reservoir rock). Alternately, well target regions could be defined on the basis of three-dimensional geo-bodies defined using volumetric property ranges and connectivity criteria (e.g. "seed detected" using seismic amplitude thresholds).

In one exemplary embodiment of the present invention, the user defines a set of software or application agents containing information on the targeting objectives to be used to assist in evaluating and optimizing the ultimate targeted regions. These agents may take a variety of forms including defining desired geometric constraints on the completion length or orientation, desired connectivity conditions with other nearby targeted regions, desired threshold ranges for volumetric properties not explicitly used to define the target region (e.g. pore pressure, stress, temperature or the like), and limits on proximity to other geologic features (e.g. faults) or cultural features (e.g. existing wells). Other examples of application agents include trajectory-related application agents and/or target and path application agents. The user may also define a hierarchy for the agents (absolute limitations versus preferences) and the desired mode(s) or methods of providing feedback to the user (e.g. generate specific visual display).

After the targeted regions are identified, targeted segments such as the first targeted segment 108 and the second targeted segment 114 are generated and evaluated. In an exemplary embodiment of the present invention, an initial set of targeted segments is generated by the software agents that generated the targeted regions. These segments define reservoir penetration intervals and potentially control the position of the well trajectory. These initial target segments could be defined manually by the user or generated using an optimization process to define the best locations given the target agent constraints defined above with respect to identifying the targeted regions.

Exemplary methods of defining targeted points are set forth in U.S. Pat. No. 6,549,879 by Cullick, et al., the entire contents of which are hereby incorporated by reference as if fully set forth herein. As set forth therein, optimal well locations can be determined from a three-dimensional reservoir model. A targeted region defined as set forth herein could be a geobody (or set of geobodies) in the model. Each voxel in the geobody may receive a well productivity proxy value. A reservoir quality value for each voxel can then be calculated. Finally, a set of optimal completion voxels that maximize reservoir quality can be determined. Targeted segments that include subsets of those voxels can then be generated and evaluated.

After the generation of targeted segments, trajectory constraints and/or evaluation parameters may be defined, according to an exemplary embodiment of the present invention. Moreover, the user may define the preferred trajectory methods (e.g. build and hold) for generating a set of well trajectories linking all or a subset of the targeted segments. The user may also specify a set of trajectory-related application agents that would facilitate the analysis and evaluation of the generated paths. The trajectory application agents may be adapted to perform a variety of functions with the overall intent of evaluating the viability, risk, and potential cost of the resultant well path. In one exemplary embodiment of the present invention, potential well trajectories and/or target segments are evaluated against anti-collision criteria. These criteria could be defined by proximity to given geological objects such as faults (for example, avoid passing too close to a specified fault surface) or other well bore characteristics (for example, maintain "safe passage" distance from other planned or existing wells). In addition, potential well trajectories and/or target segments may be evaluated against defined well trajectory geometric constraints (for example, DLS, kick-off point, hold distances or the like). Evaluation of earth property information may be automatically extracted or calculated along the well trajectory based on the earth property model created. Cost and complexity of potential drilling operations along potential trajectories may also be calculated.

Next, one or more well trajectories are generated and evaluated. In one exemplary embodiment of the present invention, a potential path or set of paths that pass through a subset of the targeted segments in the defined targeted regions is generated. The generation of these paths may trigger the target and path application agents defined as set forth above to provide feedback to the user for evaluation and analysis. One potential objective may include the utilization of the target and path agents to optimize the planned targeted segments and well trajectory on the basis of both the economic benefits or pay (e.g., target agents) and the cost or risk associated with the well path (e.g., path agents). This step could be done in either an interactive mode or using an optimization process (or perhaps a hybrid of both).

In one exemplary embodiment of the present invention, an interactive mode of operation is provided. In the interactive mode, the user may use an interaction device (for example, a mouse or the like) to "drag" a targeted segment and/or alter the path of targeted segment within the three-dimensional visualization environment. Target or path agents could be used to constrain the interactive movement to assist in honoring the constraints defined above (for example, target motion limited to defined surface and/or seismic amplitude range) and/or provide visual or other feedback to the user to evaluate the targeted segment and/or well trajectory as it is being interactively edited or once the user releases or "drops" the target. Alternatively, the user may impose an optimization process to derive a set of well trajectories satisfying the given constraints defined by the target and path agents.

During interactive manipulation or at the end of an optimization step, a variety of feedback mechanisms may be provided to assist the user in evaluating the results. One example of such a mechanism includes the automatic creation of one or more interactive sub-volume representations of one or more three-dimensional subsurface volumes (either predefined or calculated). The interactive sub-volumes could be created by target or path application agents. The size and character of the sub-volumes may be defined as the agents are created. The auto-created interactive volume/sub-volumes may be dynamic, automatically updating their positions and shapes in response to user controlled modifications of one or more of the drilling targets, the engineering constraints or algorithms, the interactive volume/sub-volume constraints, and the resulting well path. Once created, the interactive volume/sub-volume(s) can be interactively moved and display parameters can be edited to highlight or explore features of interest.

In one exemplary embodiment of the present invention, earth property information is automatically extracted or calculated along the well path based on the earth property model that has been created. These properties may be displayed along the well bore in numerous ways including: by coloring the well path object, pseudo-log type displays, or two-dimensional plots linked to the well path (for example, pore pressure, fracture gradient profiles and the like). In this mode, the extracted properties can be used to quickly screen or assess a possible well path/target scenario. For example, extracted pore pressure and fracture gradient profiles can be used to quickly determine the number of casing strings used for a given well trajectory as part of a rough-cost estimate or simply to evaluate alternative well/target scenarios. Alternatively, the extracted pore pressure and fracture gradient information can be used to screen/evaluate existing casing plans to determine their viability and identify possible issues. Under this approach, well path and design scenarios can be rapidly generated and screened much more efficiently than currently possible.

The data model used to create the proposed trajectories may be refined and updated based on an evaluation of information gathered from the well trajectories. During the process of defining and evaluating optimal well trajectories, the user may determine whether or not the planned paths are consistent with the underlying three-dimensional earth model and its corresponding engineering, geological, reservoir models. Refining and updating of the model used to create the trajectories may be performed if one or more of the proposed trajectories are not consistent with known data. The results of the analysis can then be fed back to update the data in the models. The process steps described above may be repeated to derive a new set of enhanced well trajectories.

When an acceptable trajectory is generated, engineering analysis of the well path may be performed. For example, the well path(s) defined in the previous steps could be passed on for more detailed engineering evaluation. More detailed analysis could include drilling or subsurface engineering analysis (for example, torque and drag, well operating limit or the like). These engineering analyses could also be facilitated by using path application agents defined to extract or calculate relevant earth property information that can be sent to a drilling/production engineering application and then incorporated into routine engineering analyses.

More detailed analysis could also include detailed performance analysis using a reservoir simulator. The reservoir simulation could be initiated and/or facilitated using application agents such as target agents. The target agents may be used to transmit and update the information required to conduct the simulation (for example, completion location, relevant earth property information or the like) and to analyze/compare the results of multiple scenarios.

Figure 2:
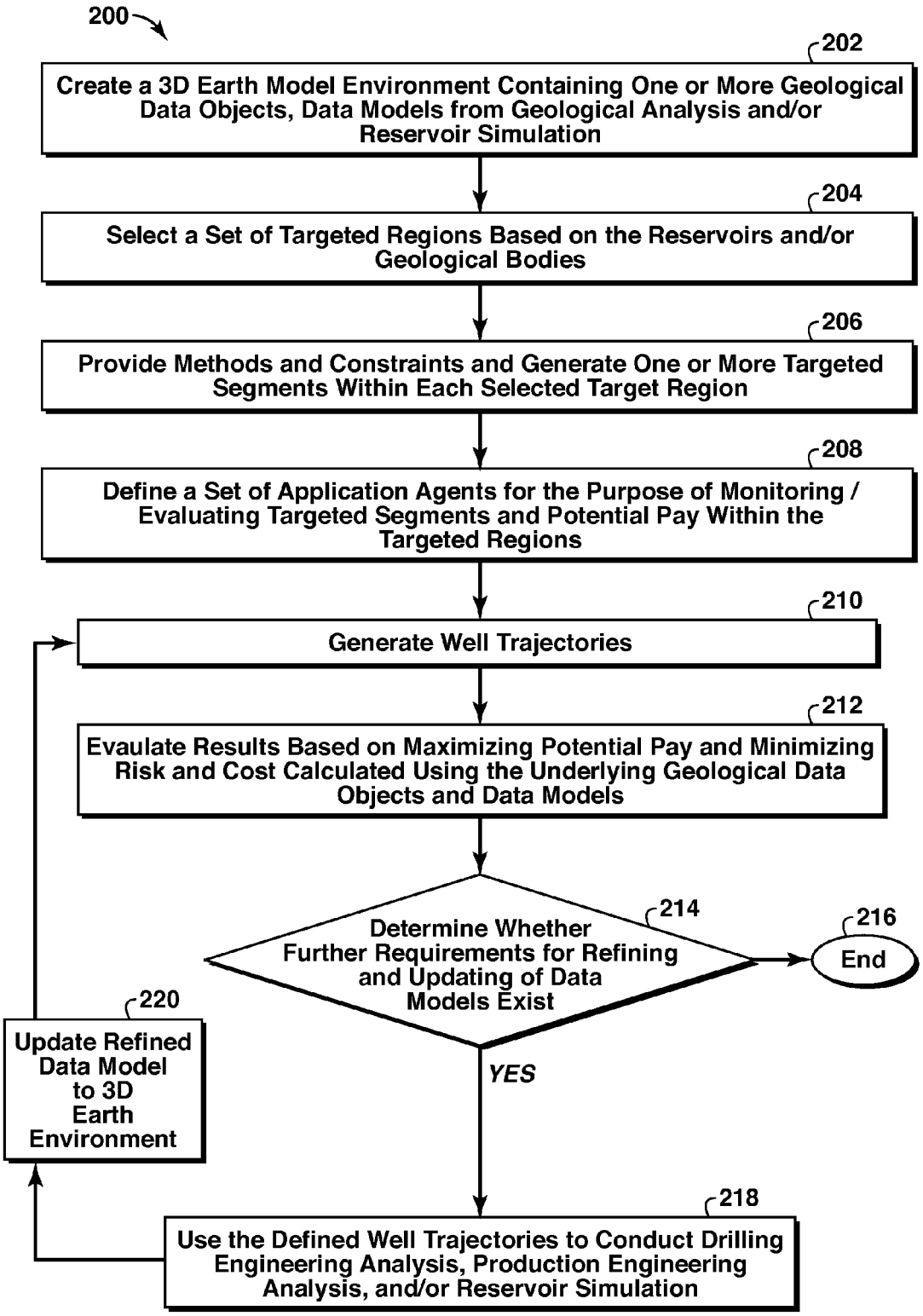
FIG. 2 is a process flow diagram that shows a method in accordance with an exemplary embodiment of the present invention.

FIG. 2 is a process flow diagram that shows a method in accordance with an exemplary embodiment of the present invention. The method is generally referred to by the reference number 200. Moreover, the method 200 may facilitate constructing, manipulating and conducting well path planning and performance analysis in a three-dimensional earth model.

At block 202, a three-dimensional shared earth model is created. In one exemplary embodiment of the present invention, the three-dimensional shared earth model comprises one or more geological data objects, data models from geological analysis and/or reservoir simulation data. Examples of geologic data objects include well traverses, well logs, surfaces, faults and the like. Engineering data included in the three-dimensional shared earth model may include well completion intervals, well perforation zones, completion designs and the like. In addition, a three-dimensional shared earth model constructed in accordance with an exemplary embodiment of the present invention may comprise proxy data volumes from pre-processing of other data sets and models, such as a distance volume, a connectivity volume and a cost volume, for example. The data models and properties from geologic model, such as horizons, porosity, horizontal permeability, vertical permeability, net to gross, facies, fluid saturations and the like may be included in the three-dimensional shared earth model constructed in accordance with an exemplary embodiment of the present invention. The data models and properties from the simulation model such as horizons, porosity, horizontal permeability, vertical permeability, and fluid saturations, fluid rates, fluid ratios, fluid cumulative, reservoir pressure, and well pressures may also be included.

At block 204, at least one targeted region is defined based on the reservoirs and/or geological bodies represented in the three-dimensional shared earth model. A targeted region is a geological region/body within the three-dimensional shared earth model characterized by its potential to contain recoverable oil and gas reserves. By way of example, a targeted region may comprise an area of reservoir sweet spots defined on the basis of extracted seismic (or other) attributes or user defined polygons. Such a targeted region may comprise high-porosity or permeability geobodies or drainage boundaries of an area of interest, for example. A targeted region may comprise an initial "kernel" or seed point and a property range. Targeted regions may be defined to remain within a defined property range and, by connectivity, to an original seed point. Those of ordinary skill in the art will appreciate that connectivity can be defined using multiple connectivity algorithms.

After the targeted regions are defined, one or more targeted segments within each targeted region are identified, as shown at block 206. The targeted segments may be defined based on methods and constraints that indicate the expected presence of hydrocarbons. The targeted segments may be defined manually by the user based on methods and constraints designed by the user. The methods and constraints desirably relate to maximizing the output of hydrocarbon resources from each of the targeted segments.

Alternatively, a set of application agents or target agents containing information on the targeting objectives to be used to assist in evaluating and optimizing the ultimate target locations may be defined. The application agents may use methods and constraints provided by a user to allow them to identify targeted segments within each targeted region.

The application agents may be adapted to determine conditions such as incidence angle in and out of the targeted regions or to determine potential targeted segments within the targeted regions. In addition, an exemplary application agent may be adapted to obtain property model data such as pore pressure, fracture gradient, temperature, lithology (sand/shale), and stress orientation and magnitude, to name just a few examples. An exemplary application agent may be adapted to identify drainage boundaries of the potential targeted segments, to check geometric constraints on targeted segments, such as DLS (Dog Leg Severity), or to check constraints on optimizing horizontal permeability ($K_h$) or other summations/averages.

At block 208, the methods and constraints are used by one or more of the application agents to monitor and evaluate the targeted segments, including the potential payout within each targeted segment. Evaluation of the targeted segments may comprise defining preferred trajectory methods (for example, build and hold) to generate a set of well trajectories linking all or a subset of the targeted segments defined as set forth above, as shown at block 210.

In one exemplary embodiment of the present invention, trajectory-related application agents may be provided with input data to allow them to identify desirable well trajectories. The trajectory-related application agents may be adapted to determine conditions to optimize well trajectories by linking from potential targeted segments in the targeted regions. In addition, the trajectory-related application agents may perform anti-collisions to geological objects or regions or perform anti-collisions among planned wells. Checking geometric constraints on well trajectory such as DLS, kick-off point, hold distance, evaluating specified locations with uncertainties or checking constraints on limits cost or the like may also be performed by the trajectory-related application agents.

Based on the well trajectories generated by the trajectory-related application agents, a potential path or set of paths that pass through a subset of the targeted segments may be generated. In one exemplary embodiment of the present invention, the generation of these paths may trigger target and path application agents previously defined. After the paths are defined, an evaluation may be performed regarding whether the planned paths are consistent with the three-dimensional earth model data for the subsurface region, including its corresponding engineering, geological, reservoir models. Based on this analysis, it may be determined whether refinements of the earth model or engineering analysis may be performed. Criteria used to evaluate the path data may include identification of the shortest measured depth well possible to achieve a certain maximum well rate (a performance limit measure). For a given well path and a given set of operating parameters, the casing design and completion type that provides the maximum rate while staying within a set of performance technical limits may be determined. Given a range of well targets, drilling constraints, casing constraints, completion detail constraints evaluation of the path data may identify the combination of these parameters that result in the highest productivity (rate as function of drawdown). Using a range of the above parameters and an economics module may allow the estimation of the cost of the wells (as a function of the above parameters), the "reward" of wells (as a function of the well performance measures) and/or identifying a combination of the above parameters that results in the more favorable economics score (net present value, rate of return or the like).

In the exemplary embodiment shown in FIG. 2, resultant well trajectories are evaluated based on maximizing potential pay, while minimizing risk and cost calculated using the underlying geological data objects and data models, as shown at block 212. At block 214, a determination is made regarding whether further requirements for refining and updating data models exist. This determination may be based on whether the trajectory data provided by the application agents is sufficiently credible. If no further refinement is needed, the method ends, as shown at block 216.

If additional refinement is determined to be desirable, the defined well trajectories are used to conduct drilling engineering analysis, production engineering analysis, reservoir simulation or the like, as shown at block 218. The three-dimensional earth model may then be updated with the refined data, as shown at block 220. Process flow continues to block 210, where well trajectories are again generated. The process continues in an iterative manner until a determination that no further refinement is needed is reached at block 214.

Figure 3:
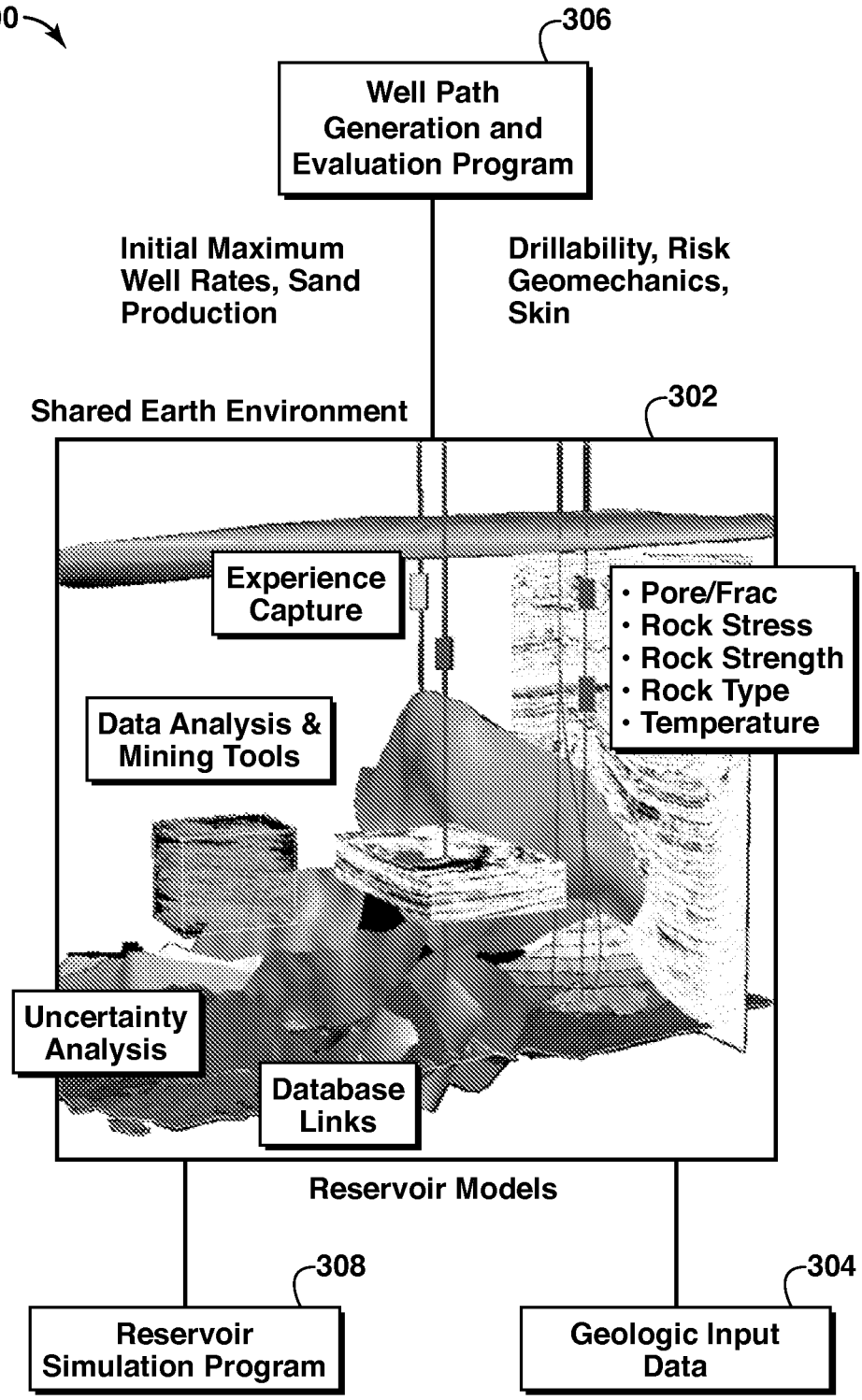
FIG. 3 is a diagram showing a system for well planning in an integrated environment in accordance with an exemplary embodiment of the present invention.

FIG. 3 is a diagram showing a system for well planning in an integrated environment in accordance with an exemplary embodiment of the present invention. The system is generally referred to by the reference number 300. As explained below, the system 300 shows an example of the use of application agents to facilitate rapid, multi-disciplinary evaluation of many alternative scenarios in accordance with an exemplary embodiment of the present invention. Moreover, an exemplary embodiment of the present invention may facilitate reduction in cycle time for well planning, while facilitating improved business decisions regarding well planning. The system 300 comprises a three-dimensional shared earth model 302.

As described above, the three-dimensional shared earth model 302 is used to integrate all relevant multi-disciplinary and multi-dimensional data. For example, the three-dimensional shared earth model comprises geologic input data 304. Collaborative teams or individuals select targeted regions within the three-dimensional environment using a variety of visualization tools and methods. Once selected, a variety of application agents can be used to define and optimize the location of targeted segments within the targeted regions. As targeted segments are created, additional application agents can be used to create and evaluate the possible trajectories connecting user or computer defined targeted regions. In the exemplary embodiment shown in FIG. 3, application agents may interact with the three-dimensional shared earth model 302 via a well path generation and evaluation program 306 and/or a reservoir simulation program 308.

As set forth above, application agents may perform a variety of functions, including analyzing the placement and orientation of the targeted segment versus the reservoir or other rock properties of the targeted region, analyzing the targeted segment versus user defined constraints on the length or geometry and/or generating visual or other feedback to assist in analysis of the targeted segments or trajectories. Additional examples of functions that may be performed by an application agent in accordance with an exemplary embodiment of the present invention include analyzing targeted segments and trajectories using data mining or knowledge management tools to compare with prior experience and uncertainty analysis. In addition, application agents may be used to facilitate more in depth analysis within other applications by providing mechanisms to automate the extraction and transmission of selected rock and trajectory properties from the integrated environment to specific functional analysis applications such as the well path generation and evaluation program 306 and/or the reservoir simulation program 308.

Figure 4:
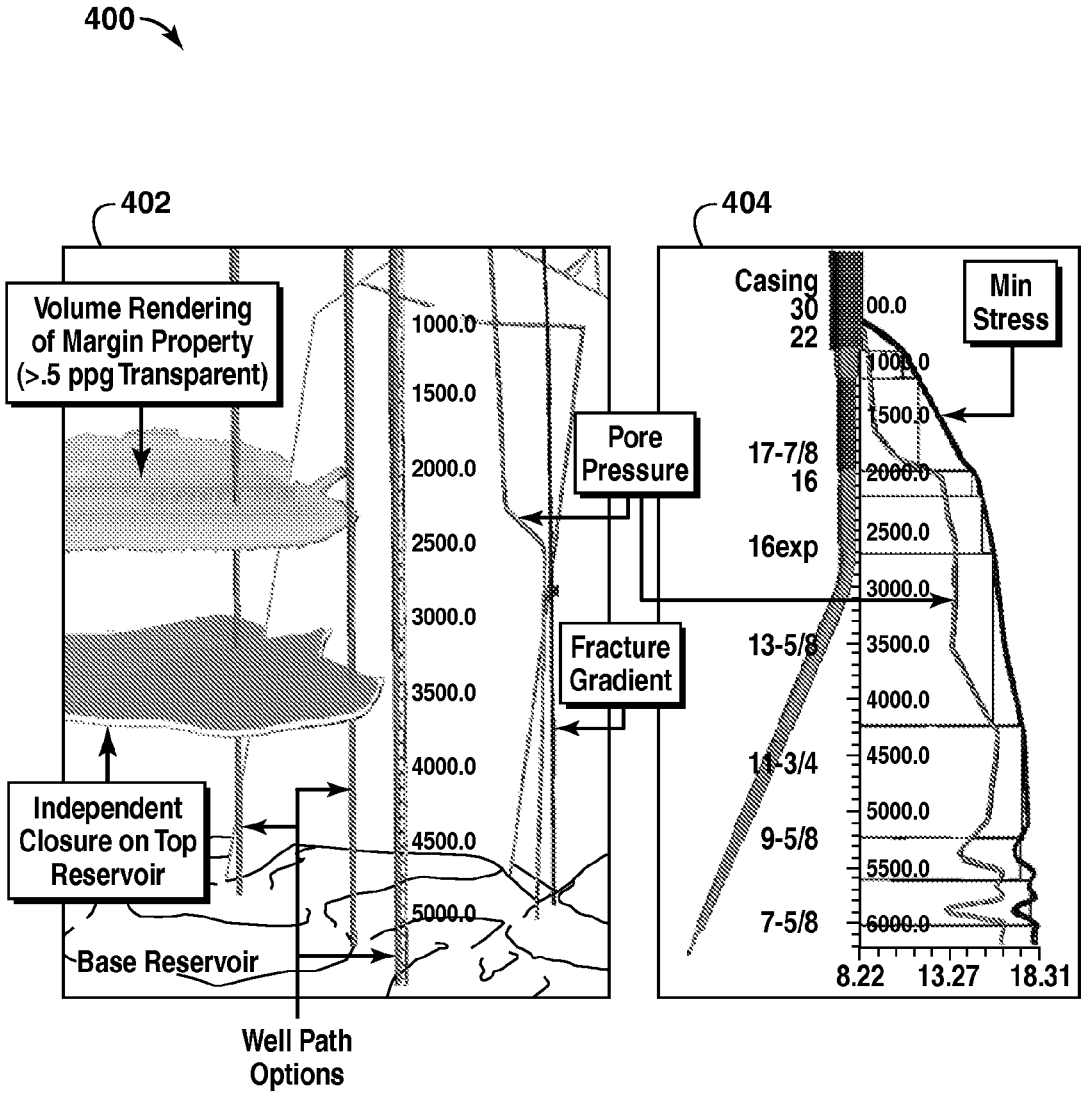
FIG. 4 is a graphical representation of a visual output created in accordance with an exemplary embodiment of the present invention.

FIG. 4 is a graphical representation of a visual output created in accordance with an exemplary embodiment of the present invention. The visual output is generally referred to by the reference number 400. The visual output 400 comprises a three-dimensional portion 402 and a two-dimensional graphical portion 404.

In the exemplary embodiment shown in FIG. 4, volumetric pore pressure and fracture gradient predictions are integrated to facilitate interactive well path planning and casing design. The volumetric pore pressure and fracture gradient predictions are displayed in the three-dimensional portion 402 of the visual output 400. A pore pressure/fracture gradient property model may be included in the three-dimensional shared earth model 302 (FIG. 3). An application agent for the targeted segments and well trajectories may be defined and may be adapted to automatically extract pore pressure and fracture gradient data along the calculated well trajectories. These properties may be displayed along the well bore in numerous ways, including for example by coloring the well path object, by using pseudo-log type displays, or by using two-dimensional plots linked to the well path such as the two-dimensional graphical portion 404.

The data shown in the three-dimensional portion 402 and the two-dimensional graphical portion 404 can be used to quickly screen or assess a possible well path/target scenario. For example, extracted pore pressure and fracture gradient profiles can be used to quickly determine the number of casing strings required for a given well trajectory as part of a rough-cost estimate or simply to evaluate alternative well/target scenarios. Alternatively, the extracted pore pressure and fracture gradient information can be used to screen/evaluate existing casing plans to determine their viability and identify possible issues. Using this approach, well path and design scenarios can be rapidly generated and screened much more efficiently than currently possible.

The three-dimensional (3-D) portion 402 is a graphical representation of a three-dimensional earth model showing interpreted horizons and faults and target reservoir. A subvolume of the 3-D subsurface data shows a rendering of the predicted margin between pore pressure and fracture gradient. Within the subvolume all areas where the margin is greater than 0.5 pounds per gallon (ppg) may be displayed as transparent and areas where the margin is <0.5 ppg (possible hazard) may be rendered in another color such as red/orange. Also shown are several possible well trajectories. The well bores are rendered as cylinders with the diameter scaled relative to the diameter of the proposed casing and may be colored to indicate areas where the margin is less than the user-defined tolerance. The well on the right (furthest off-structure) is also shown in the two-dimensional graphical portion 404, which represents a pore pressure/fracture gradient profile.

Figure 5A:
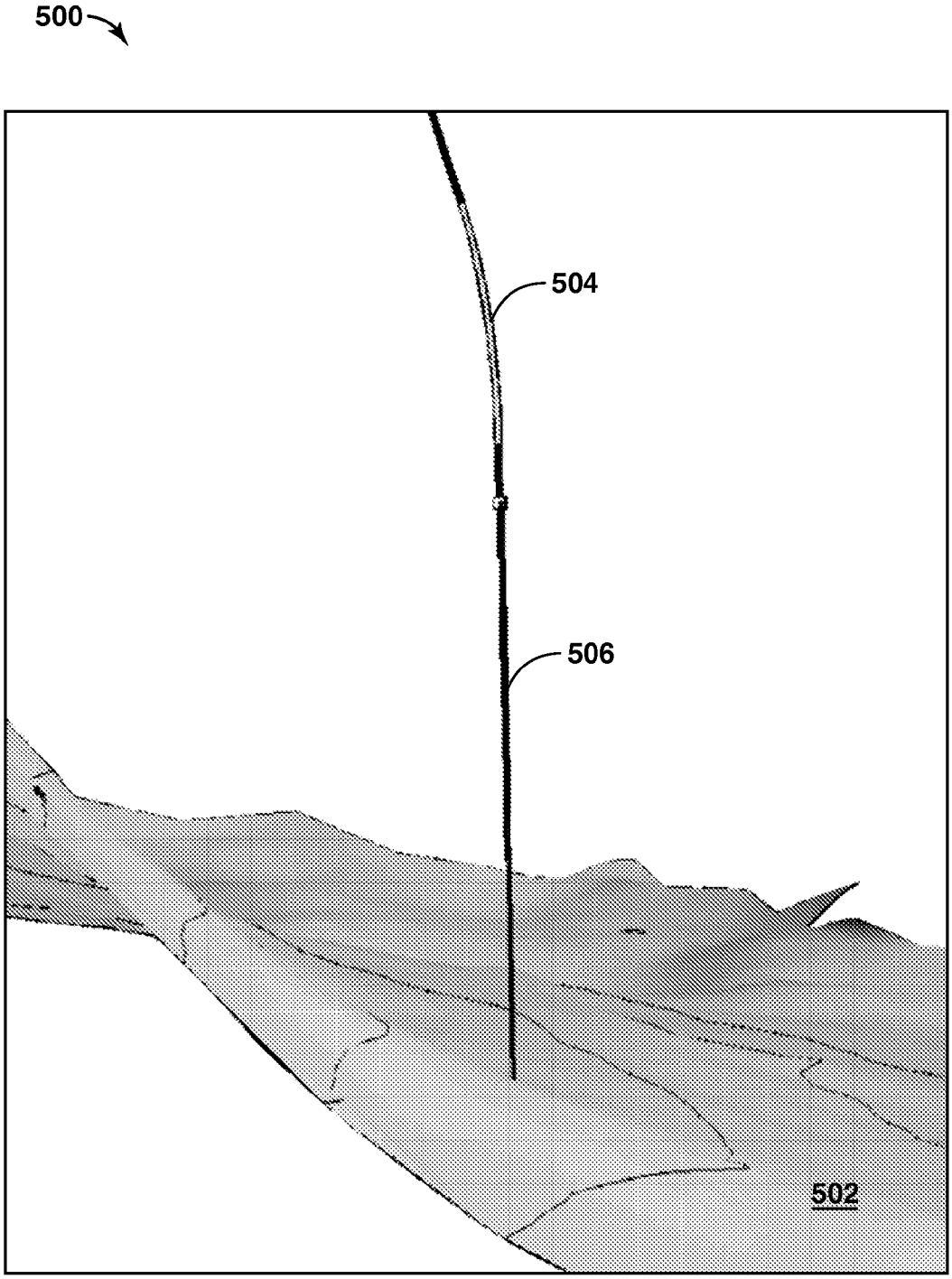
FIG. 5*a*, FIG. 5*b* and FIG. 5*c*, show three separate interactive visualizations in accordance with an exemplary embodiment of the present invention.
Figure 5B:
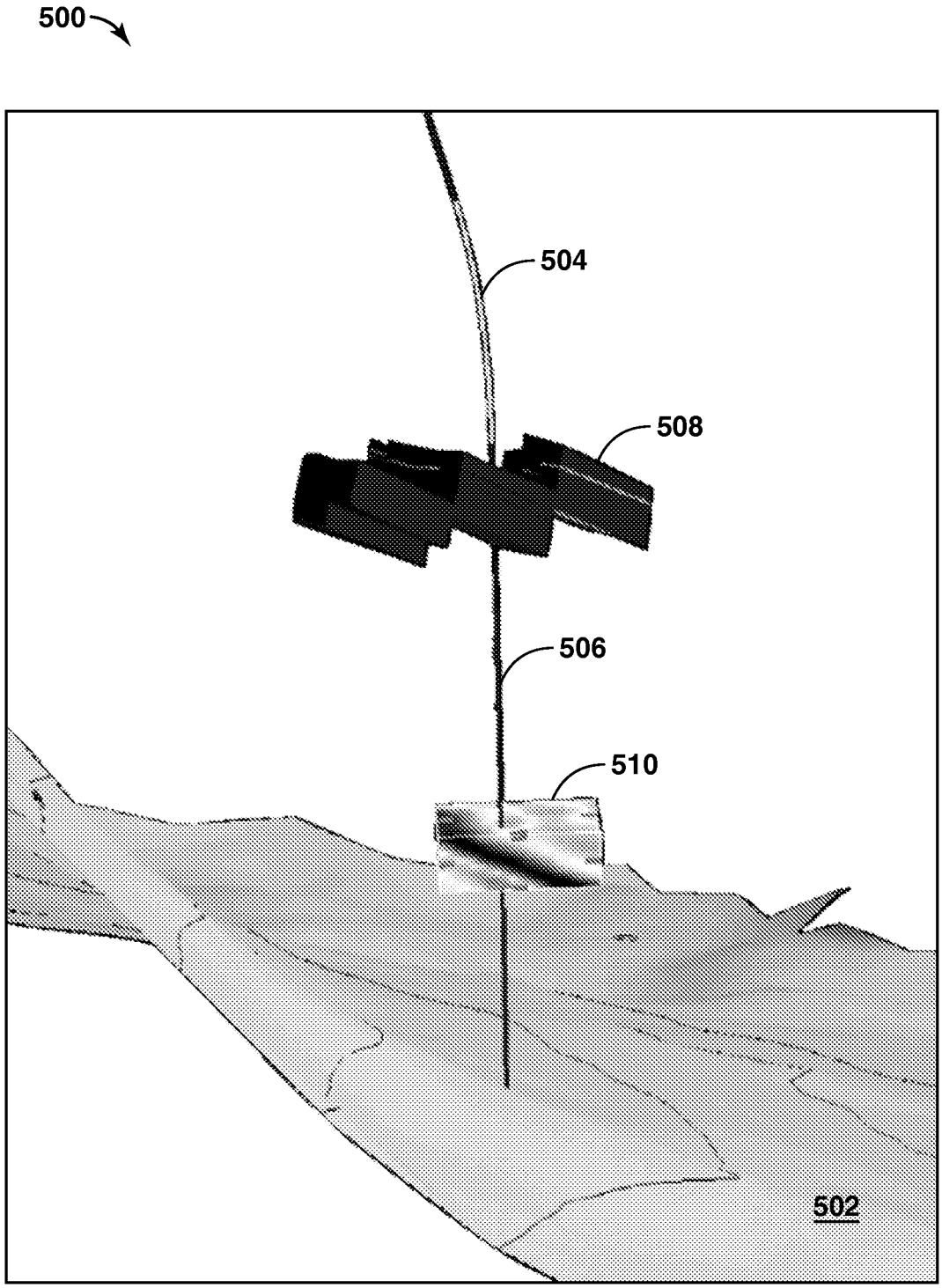
Figure 5C:
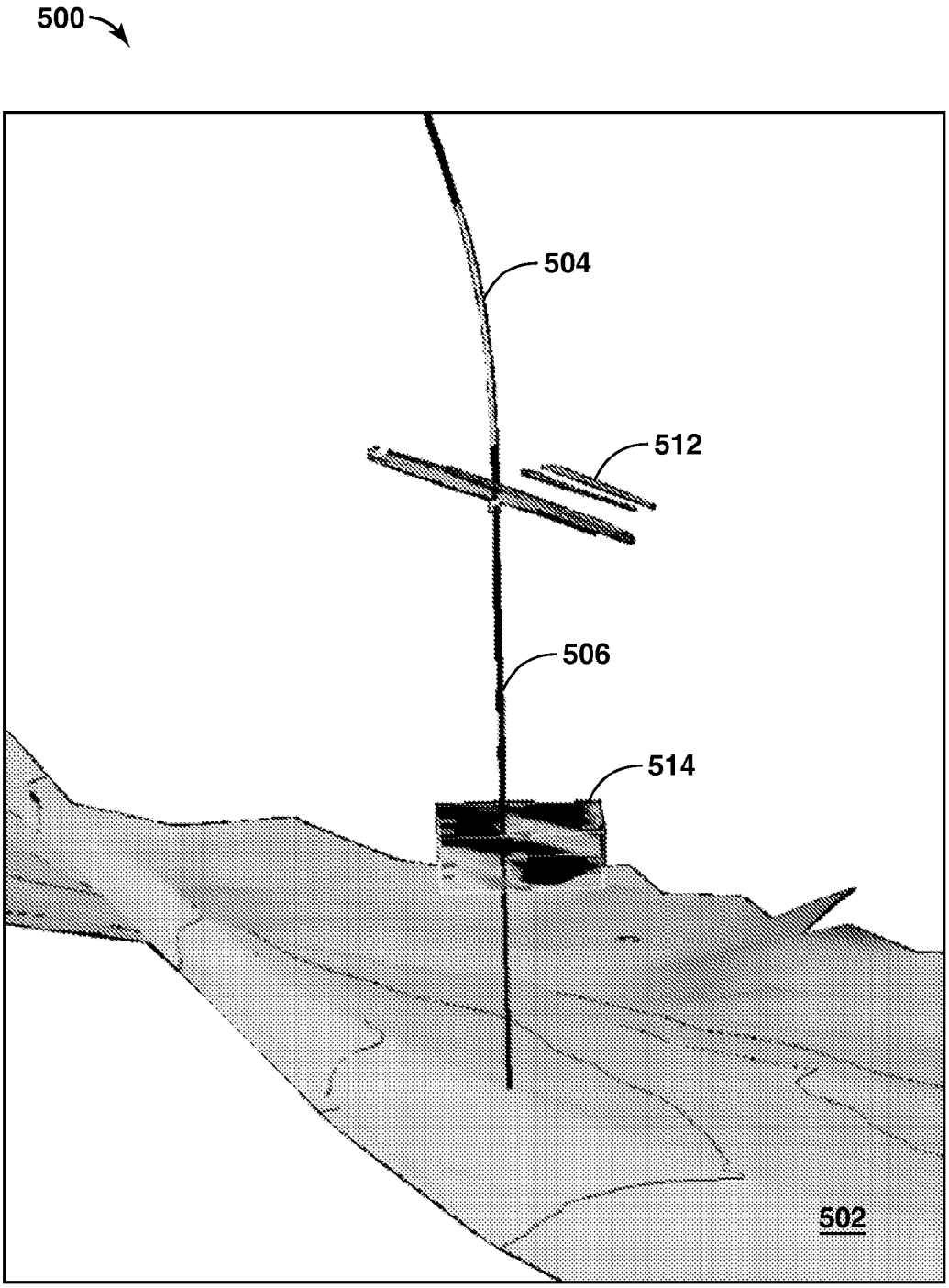

FIG. 5*a*, FIG. 5*b* and FIG. 5*c*, shows three separate interactive visualizations in accordance with an exemplary embodiment of the present invention. The scene shown in these figures is generally referred to collectively by the reference number 500. In accordance with an exemplary embodiment of the present invention, interactive applications agents may be used to perform interactive evaluation of targeted segments and well trajectories. The interactive applications agents may be defined as automatically generated volumetric probes.

The interactive application agents using dynamic sub-volumes may be created based on a set of initially selected targeted regions, engineering constraints and algorithms, targeted segments, well trajectory and the like. The location of the volume/sub-volumes(s) may be directly or indirectly controlled by one or more of the drilling targets and/or well path segments. The auto-created interactive volume/sub-volume is dynamic, automatically updating its position and shape in response to user controlled modification of one or more of the targeted segments, engineering constraints and algorithms, interactive volume/sub-volume constraints, and the resulting well trajectory. Once created, the interactive volume/sub-volume(s) can be interactively moved and display parameters can be edited to highlight or explore features of interest.

FIG. 5*a*, FIG. 5*b* and FIG. 5*c* each depict a horizon 502, which comprises information derived from a three-dimensional shared earth model. FIG. 5*a* shows a well trajectory having a first targeted segment 504 and a second targeted segment 506. FIG. 5*b* shows the targeted segments 504 and 506, and additionally shows a first subvolume 508 in a first targeted drilling region and a second subvolume 510 in a second targeted drilling region. In FIG. 5*b*, the first subvolume 508 comprises data from a geologic model and the second subvolume 510 shows seismic amplitude data. FIG. 5*c* shows the subvolumes as in FIG. 5*b*, but with opacity added relative to FIG. 5*b*. In particular, FIG. 5*c* shows a first opacity-added subvolume 512 and a second opacity-added subvolume 514.

In accordance with an exemplary embodiment of the present invention, characteristics of dynamic sub-volumes may operate to create displayed properties that are directly extracted from volumes loaded into the three-dimensional shared earth model (for example, seismic amplitude and its derivatives, geologic model, reservoir model and the like). Alternately, the displayed properties could be calculated as needed as the sub-volume is created or edited. In this case the sub-volume design constraints can include the algorithms being used to create the property.

The dimensions and shape of the interactive volume/sub-volume relative to the targeted regions or well trajectory segment may be specified by one or a combination of characteristics. Examples of such characteristics include an offset defining the interactive volume/sub-volume reference location, specified relative to the targeted segments or well trajectory segment, specified as an XYZ offset, vectorial property, which may or may not be a function of other well trajectory properties. Another exemplary characteristic may include a set of inlines/cross-lines and time/depth slices relative to the interactive volume/sub-volume reference location. Yet another example includes a distance criterion relative to the interactive volume/sub-volume reference location, which may be XYZ variant or variant as a function of a wellbore or a vectorial property of a targeted segment. Still another characteristic that may be employed includes a function of a seed detection or three-dimensional subsurface volume connectivity measure, in which case the dimensions of the interactive volume/sub-volume is controlled by a specified number of connected cells or volume of connected cells. A final example of a characteristic includes the size and shape may are determined by any algorithm(s) being used to create a new interactive volume and subsequent processing of the volume(s) containing the new property/properties.

In an exemplary method according to the present invention, the focus may be on utilizing this multi-dimensional collaboration environment to integrate geological data, engineering constraints, and reservoir information to create an integrated, highly-interactive process for improved well and depletion planning and well performance analysis. The proposed method also provides rapid, multi-disciplinary evaluation of many alternative scenarios. The exemplary method may enable greater value capture by bringing the decision making and technical analysis together for rapid execution and scenario analysis.

The skilled person will appreciate that an exemplary embodiment of the present invention may be applied to depletion planning in the context of geological constraints, drilling/production measurements, and reservoir simulation parameters. The same process could also be used in fine-tuning reservoir simulation parameters during the process of history matching.

Figure 6:
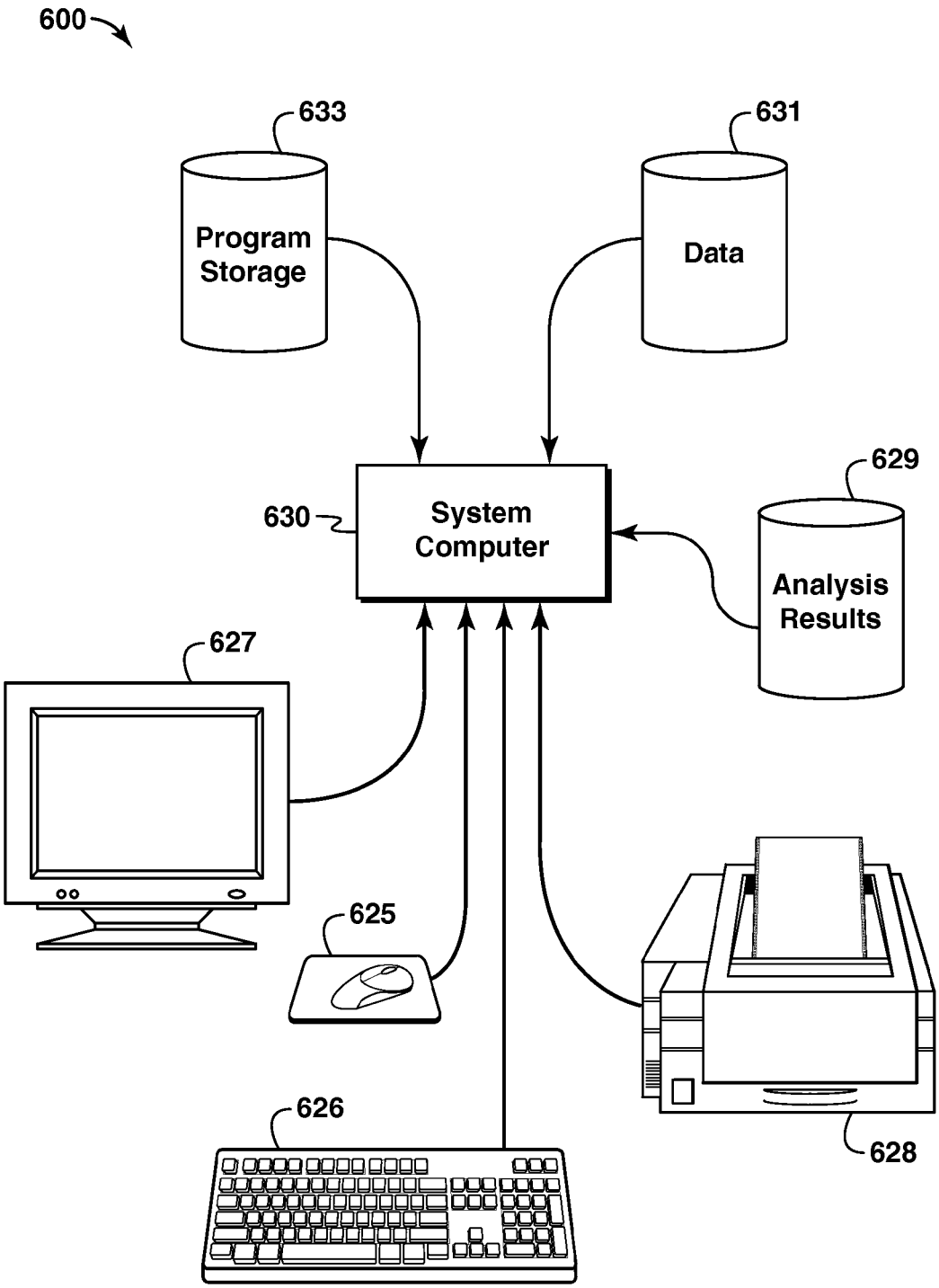
FIG. 6 illustrates an exemplary computer network that may be used to perform the method of planning a drilling operation as disclosed herein, and is discussed in greater detail below.

FIG. 6 illustrates a computer network 600, into which embodiments of the invention may be implemented. The computer network 600 includes a system computer 630, which may be implemented as any conventional personal computer or workstation, such as a UNIX-based workstation. The system computer 630 is in communication with disk storage devices 629, 631, and 633, which may be external hard disk storage devices. It is contemplated that disk storage devices 629, 631, and 633 are conventional hard disk drives, and as such, will be implemented by way of a local area network or by remote access. Of course, while disk storage devices 629, 631, and 633 are illustrated as separate devices, a single disk storage device may be used to store any and all of the program instructions, measurement data, and results as desired.

In one embodiment, the input data are stored in disk storage device 631. The system computer 630 may retrieve the appropriate data from the disk storage device 631 to perform the reservoir evaluation according to program instructions that correspond to the methods described herein. The program instructions may be written in a computer programming language, such as C++, Java and the like. The program instructions may be stored in a computer-readable memory, such as program disk storage device 633. Of course, the memory medium storing the program instructions may be of any conventional type used for the storage of computer programs, including hard disk drives, floppy disks, CD-ROMs and other optical media, magnetic tape, and the like.

According to a preferred embodiment, the system computer 630 presents output primarily onto graphics display 627, or alternatively via printer 628. The system computer 630 may store the results of the methods described above on disk storage 629, for later use and further analysis. The keyboard 626 and the pointing device (e.g., a mouse, trackball, or the like) 625 may be provided with the system computer 630 to enable interactive operation.

The system computer 630 may be located at a data center remote from the reservoir. While FIG. 6 illustrates the disk storage 631 as directly connected to the system computer 630, it is also contemplated that the disk storage device 631 may be accessible through a local area network or by remote access. Furthermore, while disk storage devices 629, 631 are illustrated as separate devices for storing input data and analysis results, the disk storage devices 629, 631 may be implemented within a single disk drive (either together with or separately from program disk storage device 633), or in any other conventional manner as will be fully understood by one of skill in the art having reference to this specification.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

What is claimed is:

1. A method of planning a drilling operation, the method comprising:

obtaining at least two or more targeted regions based on data from a three-dimensional shared earth model;

generating at least one targeted segment within each one of the at least two or more targeted regions, wherein the at least one targeted segment is a three dimensional volume defining a path through or within a respective one of the at least two or more targeted regions;

evaluating, with at least one application agent, the at least one targeted segment within each one of the at least two or more targeted regions based on a potential payout in terms of production of hydrocarbons within the at least one targeted segment, wherein at least one targeted segment is characterized by its potential to be a partial segment of a potential well trajectory and to recover hydrocarbons from the one of the at least two or more targeted regions;

identifying, after the generating and the evaluating, at least one well trajectory through the at least one targeted segment within each one of the at least two or more targeted regions, wherein the at least one application agent is adapted to define desired geometric constraints on the at least one well trajectory through the at least one targeted segment within each one of the at least two or more targeted regions; and evaluating, with the at least one application agent, the at least one well trajectory based on the potential payout in terms of at least one of production of hydrocarbons, drilling complexity, cost or stability of well planning.

2. The method recited in claim 1, comprising employing the at least one application agent to iteratively evaluate successive well trajectories through the at least one targeted segment within each one of the at least two or more targeted regions to determine an optimum well trajectory based on maximizing predicted payout of production of hydrocarbons.

3. The method recited in claim 2, comprising performing a drilling operation according to the optimum well trajectory.

4. The method recited in claim 1, comprising:

determining whether the at least one well trajectory is within a specified range with respect to at least one parameter:

performing additional analysis with respect to the well trajectory if the at least one parameter is not within the specified range;

performing no additional analysis with respect to the well trajectory if the at least one parameter is within the specified range.

5. The method recited in claim 4, comprising refining a data model based on the additional analysis.

6. The method recited in claim 1, wherein the three-dimensional shared earth model comprises a geologic data set.

7. The method recited in claim 1, wherein the three-dimensional shared earth model comprises an engineering data set.

8. The method recited in claim 1, wherein the at least one application agent is adapted to define desired connectivity conditions with at least two of the at least two or more targeted regions.

9. The method recited in claim 1, wherein the at least one application agent is adapted to produce a display of the at least one well trajectory.

10. The method of claim 1, wherein the evaluating includes selecting a targeted segment, within each one of the at least two or more targeted regions, that maximizes an output of hydrocarbons.

11. A non-transitory tangible, machine-readable medium, comprising:

code adapted to represent geologic input data;

code that is adapted to represent a well path generation and evaluation program;

code that is adapted to represent a reservoir simulation program;

code that is adapted to represent a three-dimensional shared earth model that is interacted upon by the geologic input data, the well path generation and evaluation program and the reservoir simulation program; and code that is adapted to represent at least one application agent that extracts data from the three-dimensional shared earth model via at least one of the geologic input data, the well path generation and evaluation program or the reservoir simulation program, wherein the extracted data corresponds to a well trajectory through at least one targeted segment within each one of at least one or more targeted regions, wherein the at least one targeted segment is a three dimensional volume defining a path through or within a respective one of the at least two or more targeted regions; and wherein the at least one application agent is adapted to define desired geometric constraints on the at least one well trajectory through the at least one targeted segment within each one of the at least two or more targeted regions, and wherein at least one targeted segment is characterized by its potential to be a partial segment of the at least one well trajectory and to recover hydrocarbons from the one of the at least two or more targeted regions.

12. The non-transitory tangible, machine-readable medium recited in claim 11, wherein the at least one application agent is adapted to iteratively evaluate successive well trajectories through the at least one targeted segment within each one of the at least two or more targeted regions to determine an optimum well trajectory based on maximizing predicted payout of production of hydrocarbons.

13. The non-transitory tangible, machine-readable medium recited in claim 11, wherein the at least one application agent is adapted to determine whether the at least one well trajectory is within a specified range with respect to at least one parameter.

14. The non-transitory tangible, machine-readable medium recited in claim 11, wherein the three-dimensional shared earth model comprises a geologic data set.

15. The non-transitory tangible, machine-readable medium recited in claim 11, wherein the three-dimensional shared earth model comprises an engineering data set.

16. The non-transitory tangible, machine-readable medium recited in claim 11, wherein the at least one application agent is adapted to define desired connectivity conditions with at least two of the at least two or more targeted regions.

17. The non-transitory tangible, machine-readable medium recited in claim 11, wherein the at least one application agent is adapted to produce a display of the at least one well trajectory.

18. The non-transitory tangible, machine-readable medium recited in claim 11, wherein the at least one application agent is adapted to check at least one geometric constraint of the at least one targeted segment through the at least two or more targeted regions.

* * * * *